US006382445B1

(12) United States Patent
McCandless

(10) Patent No.: US 6,382,445 B1
(45) Date of Patent: May 7, 2002

(54) LINERLESS CLOSURE WITH PRESSURE SEAL HOLDING FEATURE

(75) Inventor: Thomas J. McCandless, Crawfordsville, IN (US)

(73) Assignee: Alcoa Closure Systems International, Crawfordsville, IN (US)

( * ) Notice: Subject to any disclaimer, the term of this patent is extended or adjusted under 35 U.S.C. 154(b) by 0 days.

(21) Appl. No.: 09/602,432

(22) Filed: Jun. 23, 2000

(51) Int. Cl.[7] ..... B65D 53/00
(52) U.S. Cl. ..... 215/341; 215/344; 215/DIG. 1
(58) Field of Search ..... 215/341–344, 215/352, DIG. 1

(56) References Cited

U.S. PATENT DOCUMENTS

| | | | | |
|---|---|---|---|---|
| 3,203,571 | A | | 8/1965 | Plunkett |
| 3,784,041 | A | | 1/1974 | Birch |
| 4,061,240 | A | | 12/1977 | Brownbill |
| 4,125,201 | A | | 11/1978 | Birch |
| 4,196,818 | A | | 4/1980 | Brownbill |
| 4,220,250 | A | * | 9/1980 | Brownbill |
| 4,276,989 | A | | 7/1981 | Hicks |
| 4,398,645 | A | | 8/1983 | Toeppen |
| 4,450,973 | A | | 5/1984 | Toeppen |
| 4,540,102 | A | | 9/1985 | Wiedmer |
| 4,560,077 | A | | 12/1985 | Dutt |
| 4,598,835 | A | | 7/1986 | Brownbill |
| 4,721,221 | A | * | 1/1988 | Barriac |
| 4,971,213 | A | | 11/1990 | Ishinabe et al. |
| 5,205,426 | A | | 4/1993 | McBride et al. |
| 5,259,522 | A | | 11/1993 | Morton |
| 5,275,287 | A | | 1/1994 | Thompson |
| 5,423,444 | A | | 6/1995 | Druitt |
| 5,609,263 | A | | 3/1997 | Perchepied |
| 5,738,231 | A | | 4/1998 | Montgomery |
| 5,769,255 | A | | 6/1998 | Ohmi et al. |
| 5,782,369 | A | | 7/1998 | Tansey |
| 5,800,764 | A | | 9/1998 | Smeyak et al. |
| 5,803,286 | A | | 9/1998 | Pfefferkorn et al. |

FOREIGN PATENT DOCUMENTS

| | | | |
|---|---|---|---|
| EP | 580369 | * | 1/1994 |

* cited by examiner

*Primary Examiner*—Nathan J. Newhouse
(74) *Attorney, Agent, or Firm*—Rockey Milnamow & Katz Ltd.

(57) ABSTRACT

A closure shell has an end wall and a sidewall. The sidewall has an inside thread for engagement to a thread formation of a container neck. The closure shell has a sealing flap extending radially from the sidewall and an annular vertical member extending from the end wall. The vertical member has an inside diameter greater than the diameter of a seal finish of the container neck. The sealing flap is sized and arranged to be pressed axially by the seal finish to the end wall, and radially pressed by the seal finish to the vertical member. A resilient element is formed between the vertical member and the sidewall to radially press the vertical member against the sealing flap to effect a tight radial seal.

12 Claims, 4 Drawing Sheets

LINERLESS CLOSURE WITH PRESSURE SEAL HOLDING FEATURE

TECHNICAL FIELD OF THE INVENTION

The present invention relates generally to a plastic closure for use with an associated container, and more particularly to a linerless closure including a flexible sealing flap and an annular pressure bead or wall which cooperates to seal the sealing flap against a container finish.

BACKGROUND OF THE INVENTION

Molded plastic closures for containers have become increasingly popular for closing and sealing the contents of containers, such as for use with carbonated and non-carbonated beverages, condiments, and other food products, as well as for use on non-food products, such as motor oil. While various plastic closure constructions have been known for a number of years, special design considerations must be made in order for the desired sealing to be effective, and to facilitate high-speed manufacture and application of such closures.

In order to achieve the desired sealing performance, a number of heretofore known closure constructions have been of a composite nature, including a relatively rigid outer plastic shell, and a relatively pliable and soft inner sealing liner. Such lined closures, formed, for example, in accordance with commonly-assigned U.S. Pat. No. 4,343,754, U.S. Pat. No. 4,378,893, U.S. Pat. No. 4,407,422, and U.S. Pat. No. 4,497,795, have proven to be effective for use on containers, including containers having carbonated or otherwise pressurized contents. The desired sealing performance is achieved by configuring the closure construction to include a relatively rigid and strong, threaded outer closure cap, with an in situ formed liner positioned against an end wall portion of the cap. Closures in accordance with these patents are configured to form a so-called top/side seal, in that the liner can sealingly engage both a generally upwardly facing surface of an associated container, as well as a generally outwardly facing, side surface of the container.

Linerless closures on the other hand offer the advantage of simplifying manufacturing and reducing material costs compared to lined closures. However, the heretofore known linerless closures have not provided a seal as effective as lined closures. In a linerless closure, the sealing surface is molded from the same material as the other features of the closure. The elastic property necessary to accomplish a highly effective seal is compromised by the design requirements of other features of the closure cap, such as the structural requirements for tamper evidence features and threads. Selecting a material for the closure is therefore a balancing act, particularly when the container contents are pressurized.

Linerless closures are disclosed for example in U.S. Pat. Nos. 5,259,522; 4,540,102; 4,061,240; 5,782,369; 5,609,263; 4,196,818; 3,203,571; 4,276,989; 4,598,835; and 4,450,973.

The ability to achieve a long lasting seal and the ability to maintain the long lasting seal during adverse conditions is very important. Such adverse conditions include "doming" (i.e., material creep of the closure end wall, causing the end wall to dome outwardly) and "relaxing" (i.e., top loading of stacked bottles in a warehouse).

The present inventor has recognized that it would be desirable to provide an improved linerless closure which maintained an effective long lasting seal that remains effective during adverse conditions.

SUMMARY OF THE INVENTION

The present invention provides a linerless closure with an improved, long lasting seal. The closure includes a shell having an end wall and a depending sidewall or skirt. Within the shell, a side seal protrusion or sealing flap extends radially inwardly from the sidewall. A vertical protrusion extends axially from the end wall of the shell. A radially resilient structure is formed between the vertical protrusion and the sidewall of the shell, at the end wall.

When the closure shell is fit and tightened onto a container finish, such as onto a bottle neck, the flap is deflected by the bottle finish to bend against the vertical protrusion. The flap is sufficiently long to seal against a side region of the container finish, around the container finish radius, and to the top surface of the container finish. The top surface of the container finish axially presses the flap to the end wall of the closure shell, and the side of the container finish radially presses the flap against the vertical protrusion. The flap has one or more bends to allow the flap to better conform to the various sealing surfaces.

The flap is clamped between the side of the container finish and the vertical protrusion. The radially resilient structure can be a lattice-like gusset structure, and is configured to act as a plurality of springs which resiliently urge the vertical protrusion against the flap and the flap against the side of the container finish. Even if the closure end wall domes or relaxes, the spring action of the gusset structure will maintain the radial force needed to keep the flap sealed between the side of the container finish and the vertical protrusion.

In accordance with the invention, other resilient structures can be used instead of the lattice-like gusset structure. A sufficiently resilient solid annular member, for example, could be used to radially, resiliently urge the vertical protrusion against the flap.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
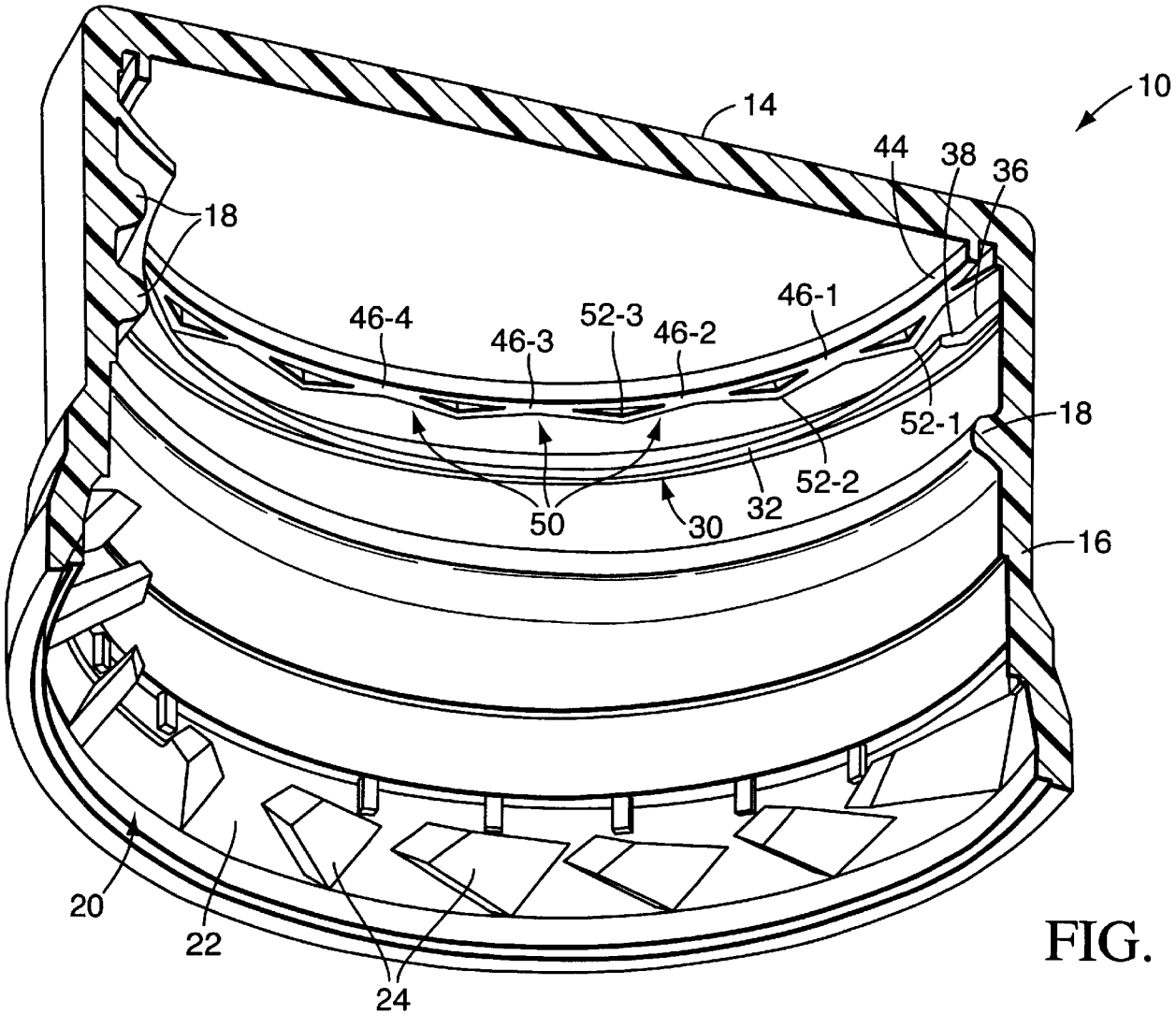
FIG. 1 is a fragmentary perspective view of a closure of the invention.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

FIG. 1 illustrates a closure 10 for fitment to a container, such as to a bottle. Although from this point forward the invention will be described as applied to a bottle, it is to be understood that the invention could be applied to a variety of containers, all of which are encompassed by the invention. The illustrated embodiment of the closure is particularly configured for use with a bottle for containing carbonated beverages.

The closure 10 is preferably formed from polypropylene and includes a circular end wall 14 and a depending sidewall or skirt 16. The skirt 16 includes threads 18 for engagement with threads of a bottle neck. The skirt 16 includes a pilfer band 20 on an end thereof. The pilfer band 20 includes an annular band portion 22, inwardly from which extends a plurality of circumferentially spaced, relatively flexible bottle engaging projections 24. Pilfer bands are described in more detail in U.S. Pat. Nos. 5,259,522, 5,205,4236, and 5,800,764, all herein incorporated by reference.

Figure 2:
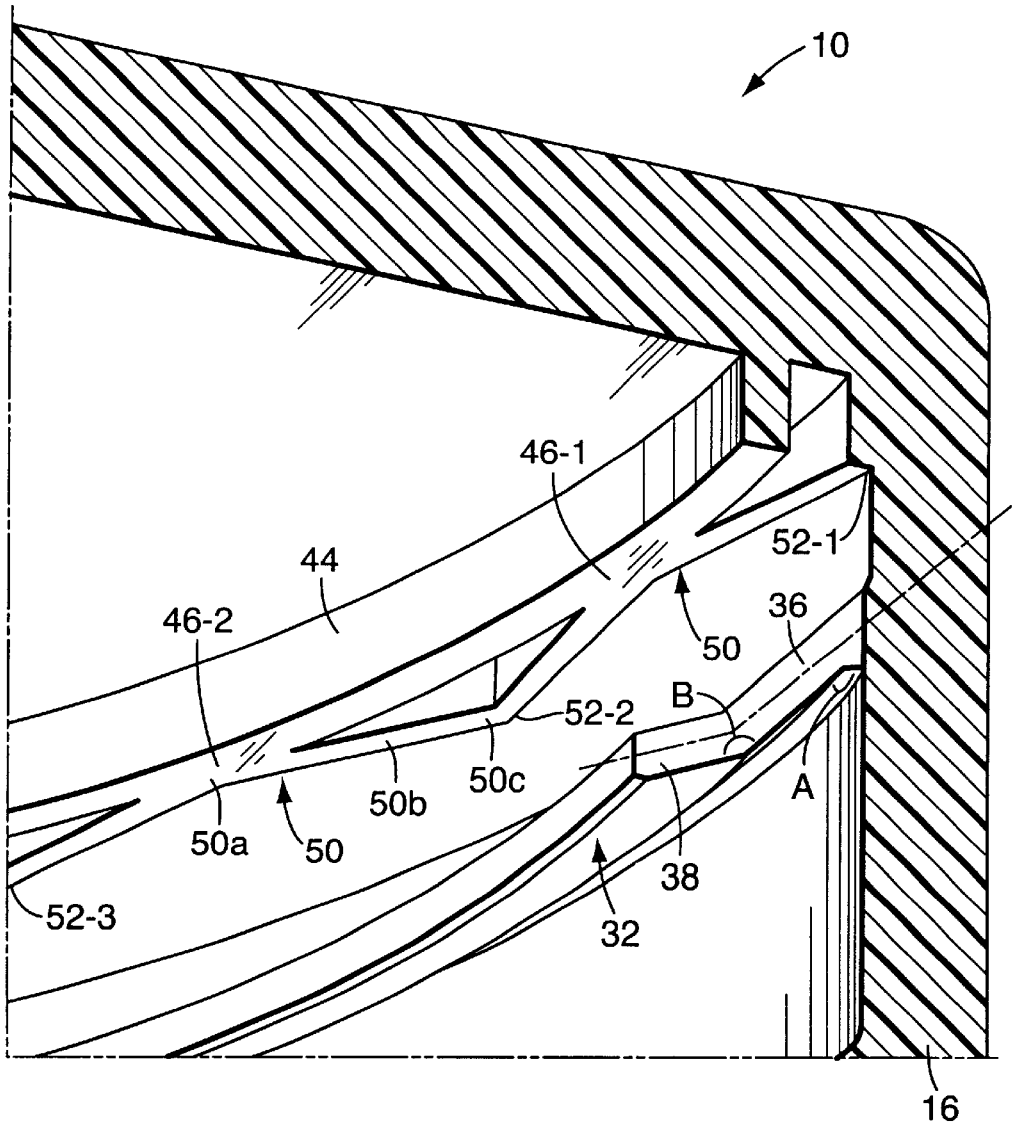
FIGS. 2 is an enlarged fragmentary view taken from FIG. 1.

As illustrated in FIG. 2, in accordance with the present invention, closure 10 includes an annular sealing flap 32 extending radially inwardly from the skirt 16. The sealing flap 32 includes a base portion 36 extending radially inwardly from the sidewall 16, and a distal portion 38 extending radially inwardly from the base portion. The base portion 36 extends from a surface of the sidewall 16 at an acute angle A. The base portion 36 and the distal portion 38 are approximately of the same thickness and are formed together at a bend 37, at an obtuse angle B.

Extending axially inwardly from the end wall 14 is an annular vertical protrusion or vertical member 44. The vertical member 44 has an inside diameter sized such as to clamp the sealing flap 32 against an outside surface of the bottle finish when the closure is fit tightly onto a bottle.

Figure 3:
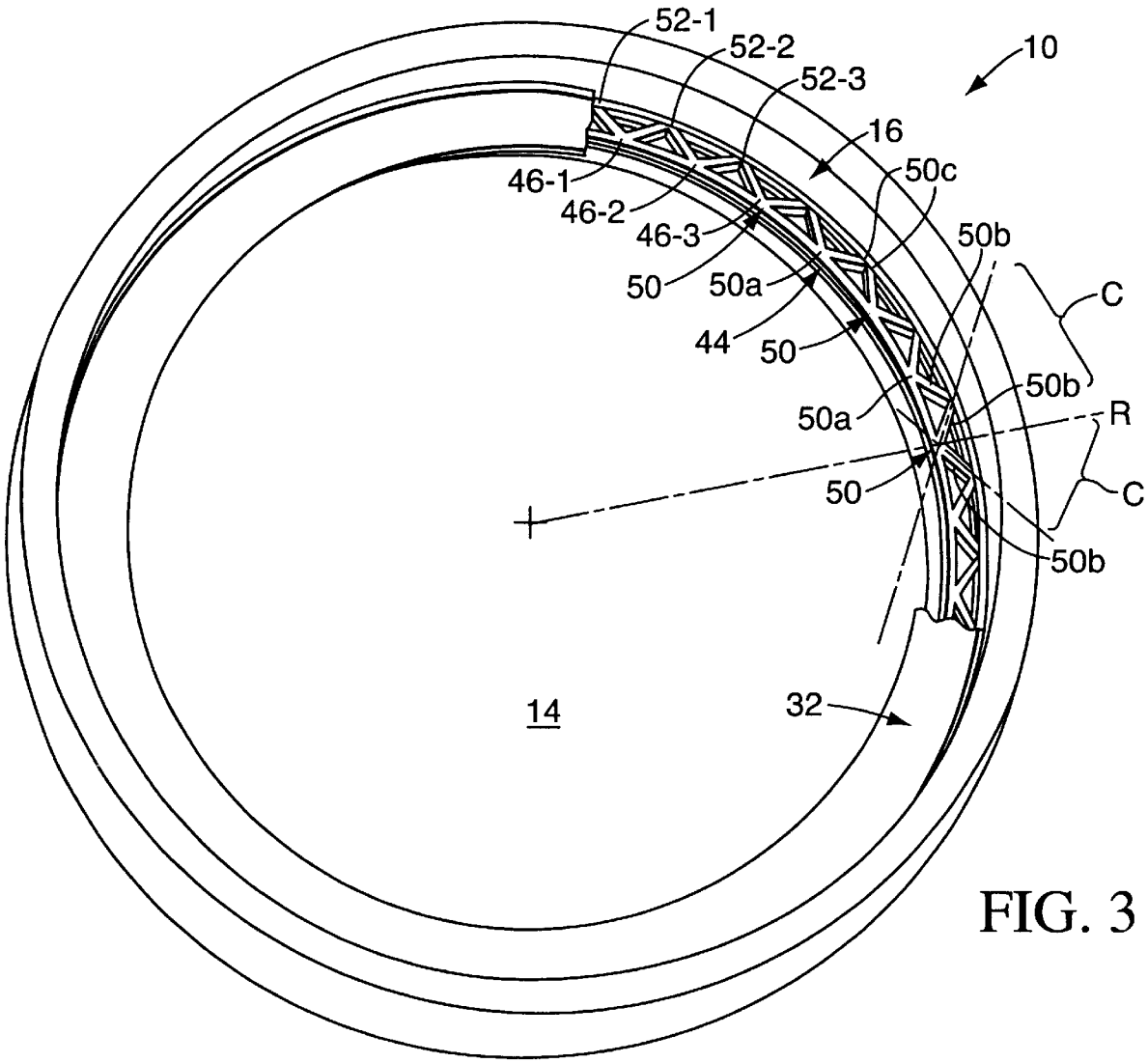
FIGS. 3 is a bottom view of the closure of FIG. 1 with a portion removed for clarity.

As illustrated in FIG. 3, the vertical member 44 is connected by a radially flexible structure, such as an annular resilient member, to the sidewall 16. In the preferred embodiment, the resilient member formed of a lattice-like gusset structure. However, other types of resilient members are possible, such as a substantially solid annular member formed of resilient material.

In the preferred embodiment, the vertical member 44 is connected at intermittent points 46-1, 46-2, 46-3, . . . **46-*n*, around its circumference by a plurality of radially directed, V-shaped members or trusses 50. The points 46-1, 46-2, 46-3, . . . 46-*n* are at the apices 50*a* of the V-shaped members. The trusses 50 include legs 50*b* which are connected to each other and to the sidewall 16 at ends 50*c* thereof at points 52-1, 52-2, 52-3, . . . 52-*n*, intermittently spaced around an inner circumference of the sidewall 16. The legs 50*b*** are arranged at an acute angle C to the radial direction R.

Figure 4:
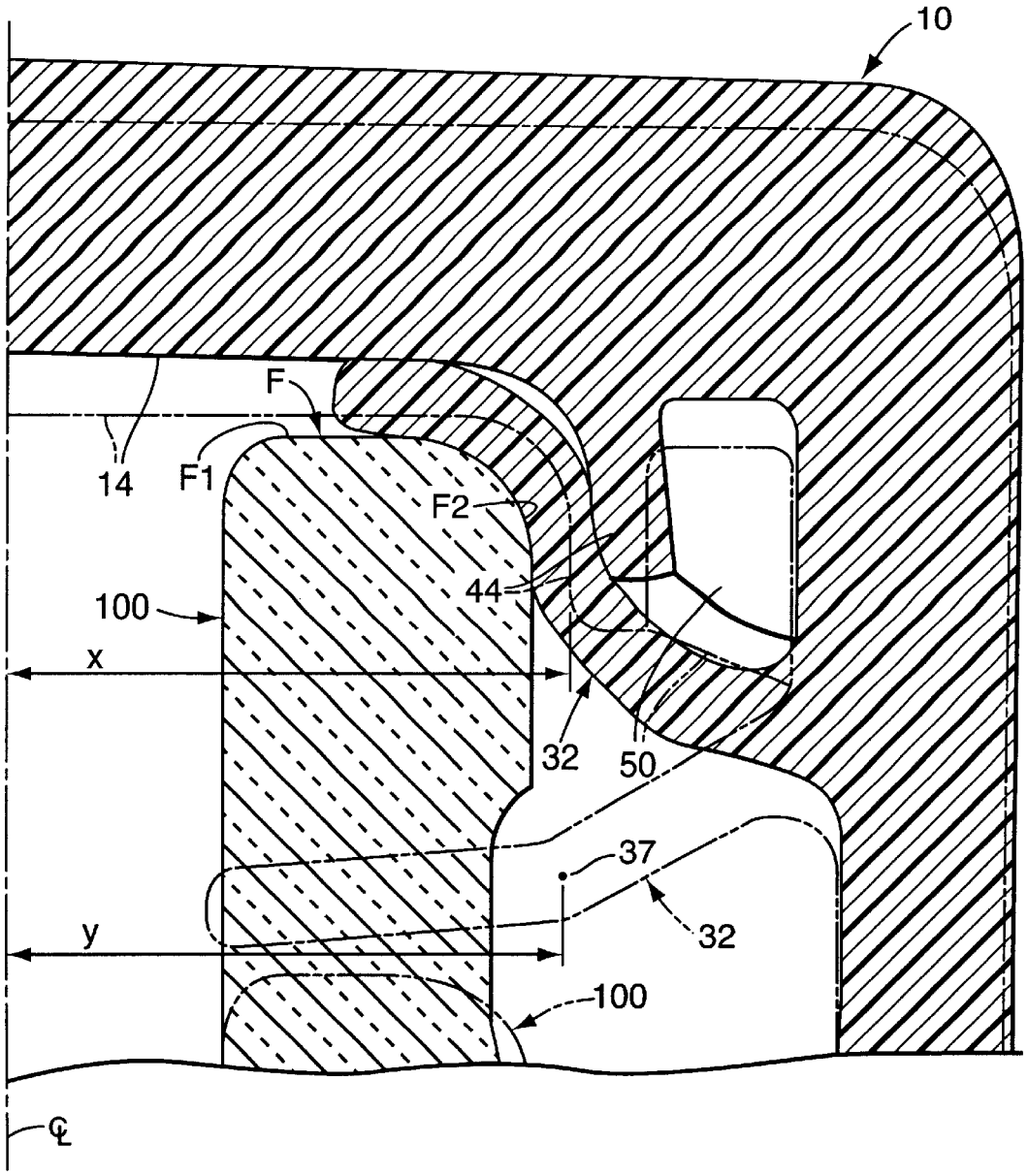
FIG. 4 is an enlarged sectional view of the closure of FIG. 1 sealed to a container finish.

FIG. 4 illustrated the closure cap 10 fit onto a bottle neck 100 having a finish F. The flap 32 is pressed by a top surface F1 of the finish F to the end wall 14. A side surface F2 of the finish F is radially pressed by the flap 32 to the vertical member 44.

The "relaxed" condition of the flap 32 and the vertical member 44 are illustrated in phantom. By "relaxed" it is meant that the flap 32 is not yet contacted by the bottle finish advancing into the closure. In a relaxed condition, the distance Y between a closure centerline CL and the bend 37 is selected to be less than the distance X between an inside edge of the vertical member 44 and the centerline CL. This relationship accommodates the bowed shape of the flap 32 once deflected after the closure is fit tightly to the finish F.

The seal flap 32 seals between the closure and the finish at two locations, between the top finish F1 and the end wall 14 and between the side finish F2 and the vertical member 44. This ensures an effective seal given distortion of the end wall 14. Because of the resilient radial force exerted by the resilient member 45 to press the flap 32 against the outside finish F2 of the bottle 100, an effective seal is maintained even if the end wall 14 of the closure distorts, i.e., domes or relaxes.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A closure, comprising:

a shell having an end wall and a depending sidewall;

a radially extending sealing flap, extending inwardly from said sidewall;

an annular vertical member extending from the end wall and engageable radially by said sealing flap when said closure is fit onto a container; and a resilient element arranged between said vertical member and said sidewall to resiliently press said vertical member against said sealing flap when said closure is fit onto a container, said resilient element comprising a plurality of members each arranged at an acute angle from a radial direction.

2. The closure according to claim 1, wherein said sealing flap, in a relaxed condition, extends radially at an oblique angle from a surface of said sidewall, in a direction away from said end wall.

3. The closure according to claim 1, wherein said sealing flap, in a relaxed condition, has a base portion and a distal portion formed together radially at an obtuse angle.

4. A container sealing system, comprising:

a container neck having a seal finish and a thread formation on an outside surface thereof;

a closure shell having an end wall and a sidewall, said sidewall having an inside thread for engagement to the thread formation of said neck;

said closure shell having a radially extending sealing flap and an annular vertical member extending from said end wall, said vertical member having an inside diameter greater than the diameter of said container neck seal finish;

said sealing flap sized and arranged to be pressed axially by said seal finish to said end wall, and radially pressed by said seal finish to said vertical member; and a resilient element formed between said vertical member and said sidewall to radially press said vertical member against said sealing flap, wherein said resilient element comprises a plurality of members each arranged at an acute angle from a radial direction.

5. The system according to claim 4, wherein said sealing flap, in a relaxed condition, extends radially at an oblique angle from a surface of said sidewall, in a direction away from said end wall.

6. The system according to claim 4, wherein said sealing flap, in a relaxed condition, has a base portion and a distal portion formed together radially at an obtuse angle.

7. A closure, comprising:

a shell having an end wall and a depending sidewall;

a radially extending sealing flap, extending inwardly from said sidewall;

an annular vertical member extending from the end wall and engageable radially by said sealing flap when said closure is fit onto a container; and a resilient element arranged between said vertical member and said sidewall to resiliently press said vertical member against said sealing flap when said closure is fit onto a container, wherein said resilient element comprises an annular lattice-like structure having members arranged at an acute angle from a radial direction.

8. A closure, comprising:

a shell having an end wall and a depending sidewall;

a radially extending sealing flap, extending inwardly from said sidewall;

an annular vertical member extending from the end wall and engageable radially by said sealing flap when said closure is fit onto a container; and a resilient element arranged between said vertical member and said sidewall to resiliently press said vertical member against said sealing flap when said closure is fit onto a container, wherein said sealing flap, in a relaxed condition, has a base portion and a distal portion formed together radially at an obtuse angle, said closure having a vertical centerline, and a first radial distance between a point where said base portion is connected to said distal portion is less than a second radial distance between an inside surface of said vertical member and said centerline.

9. A closure, comprising:

a shell having an end wall and a depending sidewall;

a radially extending sealing flap, extending inwardly from said sidewall;

an annular vertical member extending from the end wall and engageable radially by said sealing flap when said closure is fit onto a container; and a resilient element arranged between said vertical member and said sidewall to resiliently press said vertical member against said sealing flap when said closure is fit onto a container, wherein said resilient element comprises a plurality of radially directed, V-shaped spring elements arranged having apices connected to an outside surface of said vertical member, and having legs connected to an inside surface of said sidewall.

10. A container sealing system, comprising:

a container neck having a seal finish and a thread formation on an outside surface thereof;

a closure shell having an end wall and a sidewall, said sidewall having an inside thread for engagement to the thread formation of said neck;

said closure shell having a radially extending sealing flap and an annular vertical member extending from said end wall, said vertical member having an inside diameter greater than the diameter of said container neck seal finish;

said sealing flap sized and arranged to be pressed axially by said seal finish to said end wall, and radially pressed by said seal finish to said vertical member; and a resilient element formed between said vertical member and said sidewall to radially press said vertical member against said sealing flap, wherein said resilient element comprises an annular lattice-like structure having members arranged at an acute angle from a radial direction.

11. A container sealing system, comprising:

a container neck having a seal finish and a thread formation on an outside surface thereof;

a closure shell having an end wall and a sidewall, said sidewall having an inside thread for engagement to the thread formation of said neck;

said closure shell having a radially extending sealing flap and an annular vertical member extending from said end wall, said vertical member having an inside diameter greater than the diameter of said container neck seal finish;

said sealing flap sized and arranged to be pressed axially by said seal finish to said end wall, and radially pressed by said seal finish to said vertical member; and a resilient element formed between said vertical member and said sidewall to radially press said vertical member against said sealing flap, wherein said sealing flap, in a relaxed condition, has a base portion and a distal portion formed together radially at an obtuse angle, wherein said closure having a vertical centerline, and a first radial distance between a point where said base portion is connected to said distal portion and said centerline is less than a second radial distance between an inside surface of said vertical member and said centerline.

12. A container sealing system, comprising:

a container neck having a seal finish and a thread formation on an outside surface thereof;

a closure shell having an end wall and a sidewall, said sidewall having an inside thread for engagement to the thread formation of said neck;

said closure shell having a radially extending sealing flap and an annular vertical member extending from said end wall, said vertical member having an inside diameter greater than the diameter of said container neck seal finish;

said sealing flap sized and arranged to be pressed axially by said seal finish to said end wall, and radially pressed by said seal finish to said vertical member; and a resilient element formed between said vertical member and said sidewall to radially press said vertical member against said sealing flap, wherein said resilient element comprises a plurality of radially directed, V-shaped spring elements arranged having apices connected to an outside surface of said vertical member, and having legs connected to an inside surface of said sidewall.

* * * * *